United States Patent [19]

Rosenberg et al.

[11] 3,971,879

[45] July 27, 1976

[54] HIGH FREQUENCY CABLE WITH BRIDGING STRIP

[75] Inventors: Lee J. Rosenberg, Deerfield; E. Mark Wolf, Sycamore, both of Ill.

[73] Assignee: The Anaconda Company, New York, N.Y.

[22] Filed: Jan. 31, 1972

[21] Appl. No.: 222,205

[52] U.S. Cl. ..... 174/36; 174/107

[51] Int. Cl.[2] ..... H01B 11/06

[58] Field of Search ..... 174/107, 102 R, 110 F, 174/110 PM, 28, 105 R, 106 R, 115, 36

[56] References Cited

UNITED STATES PATENTS

| | | | |
|---|---|---|---|
| 2,589,700 | 3/1952 | Johnstone | 174/106 |
| 2,697,772 | 12/1954 | Kinghorn | 174/102 R |
| 3,315,025 | 4/1967 | Tomlinson | 174/107 |
| 3,439,111 | 4/1969 | Miracle et al. | 174/107 |
| 3,629,489 | 12/1971 | Jachimowicz | 174/107 |
| 3,634,606 | 1/1972 | Iyengar | 174/107 X |
| 3,643,008 | 2/1972 | Brazee | 174/107 |
| 3,662,090 | 5/1972 | Grey | 174/107 |

*Primary Examiner*—Arthur T. Grimley
*Attorney, Agent, or Firm*—Pennie & Edmonds

[57] ABSTRACT

In a high-frequency communication cable with foam plastic insulation and an outer conducting tape having a bonded longitudinal overlapped seam, a separate metal bridging strip is inserted under the seam.

3 Claims, 1 Drawing Figure

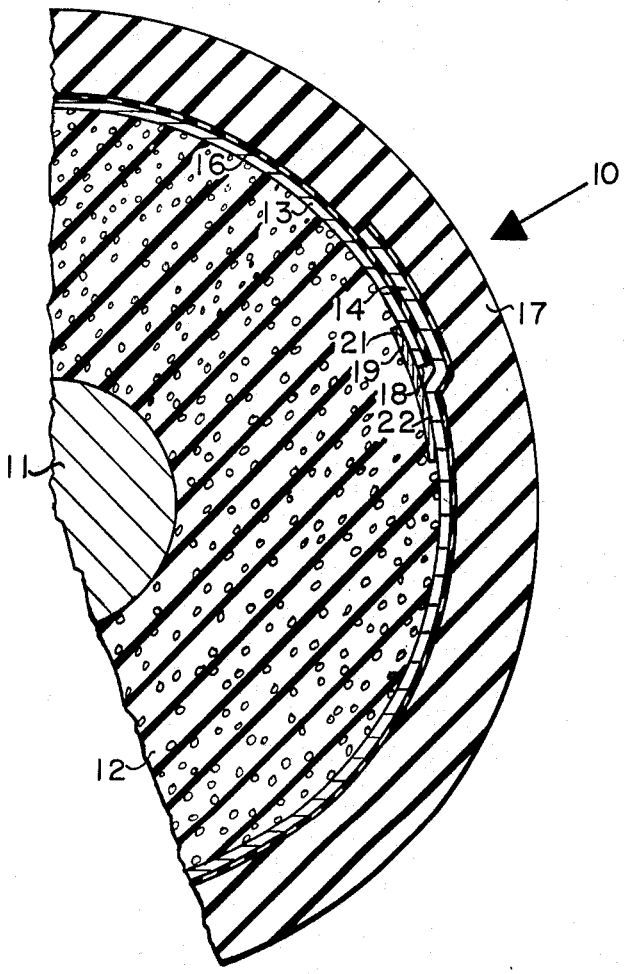
10
16
13
14
17
21
19
18
22
11
12

HIGH FREQUENCY CABLE WITH BRIDGING STRIP

BACKGROUND OF THE INVENTION

In U.S. Pat. No. 3,315,025 to Tomlinson, the disclosures of which are incorporated herein by reference, there have been described cables for the transmission of high-frequency signals, particularly television signals and characterized by having expanded insulations and an outer metal tape coated with an adhesive that bonds the tape to a heavy polymeric jacket and also bonds together an overlapping longitudinal seam in the tape itself. Although the thickness of the adhesive is very low, not exceeding 0.002 inch, it does constitute a hiatus between the metallic portions of the tape. This hiatus acts as a window in the shielding afforded by the tape in that it permits leakage of some radiation from the cable. This leakage increases with frequency. In an application by W. L. Grey, S.N. 134,560 now U.S. Pat. 3,662,090, assigned to the assignee of the present invention, means have been suggested of folding the conductor tape or omitting a strip of its adhesive, so as to provide metal-to-metal contact within the area of the overlapped seam. These means are, however, costly of execution, and a simpler, less expensive means of closing the window in the cable shielding has now been discovered.

SUMMARY

We have invented a high-frequency communications cable that can be simply and economically manufactured with commercially available cable apparatus, which effectively closes the window created by the adhesive film at the overlap cable tape seam, and which can be used with existing terminals and connectors. This cable comprises an elongated conductor, a wall of expanded polyolefinic insulation surrounding the conductor and a metal, such as an aluminum tape, surrounding the wall of insulation. The tape has a longitudinal overlapped seam and is surrounded by a solid, abrasion-resistant synthetic-resinous jacket. A layer of adhesive bonds the outer surface of the tape to the jacket and bonds the tape to itself at the seam. This adhesive comprises a fine longitudinal hiatus between the metallic portions of the tape and we provide a longitudinal strip of metal, such as aluminum, under the seam, compressed against the tape by the insulation. The strip comprises continuous areas of metal-to-metal contact with the tape on both sides of the hiatus. Preferably the tape of our cable will have a thickness of 0.003–0.010 inch and the thickness of the strip will not be substantially greater than that of the tape.

BRIEF DESCRIPTION OF THE DRAWING

The FIGURE shows a fragment of a section through a cable of our invention.

DETAILED DESCRIPTION OF PREFERRED EMBODIMENT

Referring to the FIGURE, a cable of our invention, indicated generally by the numeral 10, useful for transmitting television signals, has a central copper conductor 11, surrounded by an expanded polyethylene insulation wall 12. Copper is chosen for the conductor 11 because of its high electrical conductivity, but where cables are intended to be used in short lengths and, where tensile strength is a governing factor, the copper may be reinforced with a steel core. Silver and aluminum may also be used for the central conductor under appropriate circumstances within the scope of our invention and an expanded polypropylene or other polyolefinic material, such, for example, as a blend may be used for the insulation wall 12. The illustrated cable 10 is a coaxial cable and its outer conductor is formed by an aluminum tape 13 folded in a longitudinal overlapped seam 14. A layer or film 16 of adhesive bonds the tape 13 to a thick polyethylene jacket 17. As so far described, the cable 10 is not different from that shown in FIG. 1 of the U.S. Pat. No. 3,315,025.

It will be seen that the adhesive 16 within the seam 14 comprises a fine nonmetallic window for the leakage of radiation, particularly ultra high frequency radiation past the tape 13 which functions as an electrical shield. The entrance to this window from the interior of the cable takes the physical form of a hiatus or gap 18 between the metal portions of the tape. To seal this hiatus 18, we have inserted a strip 19 of aluminum which bridges the hiatus 18, making metal-to-metal contact with the tape 13 in the areas 21, 22 on either side of the hiatus. The contact is maintained by compression of the strip 19 against the tape 13 by the insulation 12 and it is important, for generating this compression, that the tape 13 be folded tightly around the cable core. We have found, surprisingly, that, although the strip 19 is not bonded it will effectively seal the radiation window in the cable after repeated flexing and temperature cycling. In the illustrated cable with an overall diameter of 0.555 inch the tape 13 has a thickness of 0.008 inch and the strip 19 a thickness of 0.005 inch. We have found, again surprisingly, that the insertion of the strip 19, although it would appear to distort the circularity of the cable geometry, has had no appreciably adverse effect on the capacitance, velocity of propagation, characteristic impedance, or attenuation of the cable when tested at frequencies from 3–300 megahertz. The strip 19 should not, however, substantially exceed the tape 13 in thickness and when it is formed of aluminum, should itself be at least 0.003 inch thick, in order to have sufficient stiffness to maintain contact at the areas 21, 22. When an inately stiffer metal or alloy is employed for the strip 19, the thickness may be reduced below 3 mils. In the illustrated half-inch diameter cable, the width of the strip is one-half inch and it should be centered well enough to provide a minimum of 3/16 inch circumferential contact distance on either side of the hiatus 18.

A measure of the effectiveness of a cable shielding is known as the Figure of Merit, equal to $20 \log_{10}(V_B/V_S)$ where $V_B$ represents the voltage applied to the conductors 11 at a given frequency and $V_S$ the voltage at that frequency leaking through the shield. In the second column of the table below we show Figures of Merit for a cable conforming to the FIGURE but absent the strip 19. We also show Figures of Merit for two cable specimens conforming to the cable 10 comprising the strip 19, in the third and fourth columns. The width of the seam 14 in each case was about 0.32 inch.

In columns five and six of the table, we have shown Figures of Merit of cables 10 made to our invention before and after these cables were heated at 165°F. in an atmosphere with 20% humidity for 64 hours. From columns five and six it is evident that the advantages of our invention are retained through aging.

TABLE

| Frequency MHz | No Strip | Figure Of Merit With Bridging Strip $D_6$ | $D_7$ | Aged Before | After |
|---|---|---|---|---|---|
| 20 | 60.0 | α | α | — | — |
| 50 | 52.0 | 71.6 | 77.6 | 66.5 | 65.6 |
| 75 | 54.6 | α | 86.3 | 70.1 | 65.5 |
| 100 | 47.7 | 71.2 | 71.8 | 62.8 | 55.1 |
| 150 | 38.0 | 66.4 | 70.8 | 57.3 | 49.4 |
| 175 | 37.5 | 60 | 69.4 | 62.3 | 50.6 |
| 190 | 35.0 | 69.2 | 65.6 | 53.2 | 40.0 |
| 250 | 37.6 | α | 70.3 | 46.1 | 40.8 |
| 275 | 42.8 | 60 | 60 | 58.8 | 43.5 |
| 300 | 39.0 | 60 | 60 | 54.7 | 37.9 |

Cables of the type shown in FIG. 1 of the U.S. Pat. No. 3,315,025 patent are widely used, especially for TV transmission, and hardware for connecting such cables has been standarized. It is commercially advantageous that this hardware should be usable on any modified cable. We have found that no change in hardware is required for our improved cable, since ends of the free strip 19 can simply be severed from the cable at cut sections.

The foregoing description has been exemplary rather than definitive of our invention for which we desire an award of Letters Patent as defined in the following claims.

We claim:

1. A television-frequency communication cable comprising:

A. an elongated metallic conductor,

B. a wall of expanded polyolefinic insulation surrounding said conductor,

C. a metal tape surrounding said wall, said tape comprising a longitudinal overlapped seam, D. a solid, abrasion-resistant synthetic-resinous jacket surrounding said tape, E. a layer of adhesive bonding the outer surface of said tape to said jacket and bonding said tape to itself at said seam, said adhesive comprising a fine longitudinal hiatus between the metallic portions of said tape, F. a longitudinal strip of metal under said seam, said strip being compressed against said tape by said insulation, being free from bonding to said tape, and said strip comprising continuous areas of metal-to-metal contact with said tape on both sides of said hiatus.

2. The cable of claim 1 wherein said tape has a thickness of 0.003–0.010 inch and the thickness of said strip is not substantially greater than the thickness of said tape.

3. The cable of claim 1 wherein said tape and said strip comprise aluminum.

* * * * *